US009102487B2

(12) United States Patent
Tojima et al.

(10) Patent No.: US 9,102,487 B2
(45) Date of Patent: Aug. 11, 2015

(54) CORRUGATED CARDBOARD SHEET FEEDER

(71) Applicant: RISO KAGAKU CORPORATION, Tokyo (JP)

(72) Inventors: Takahito Tojima, Ibaraki (JP); Kenji Kudo, Ibaraki (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 14/341,041

(22) Filed: Jul. 25, 2014

(65) Prior Publication Data

US 2015/0028534 A1 Jan. 29, 2015

(30) Foreign Application Priority Data

Jul. 29, 2013 (JP) ..... 2013-156412

(51) Int. Cl.
*B65H 3/24* (2006.01)
*B65H 3/46* (2006.01)
*B65H 1/06* (2006.01)

(52) U.S. Cl.
CPC .. *B65H 3/24* (2013.01); *B65H 1/06* (2013.01); *B65H 3/46* (2013.01); *B65H 2301/42322* (2013.01)

(58) Field of Classification Search
CPC ..... B65H 1/06; B65H 3/24; B65H 3/46; B65H 2301/42322
USPC ..... 271/131, 133–135, 141
See application file for complete search history.

(56) References Cited

U.S. PATENT DOCUMENTS

| | | | | | |
|---|---|---|---|---|---|
| 2,540,162 | A * | 2/1951 | Bowersock | 271/141 |
| 2,936,909 | A * | 5/1960 | Gard | 198/443 |
| 3,414,258 | A * | 12/1968 | Brown | 271/133 |
| 3,675,918 | A * | 7/1972 | Henc et al. | 271/143 |
| 3,923,297 | A * | 12/1975 | Barny | 271/132 |
| 4,131,208 | A * | 12/1978 | Vuilleumier | 414/797.9 |
| 4,181,298 | A * | 1/1980 | Capdeboscq | 271/5 |
| 4,227,687 | A * | 10/1980 | Schoonmade | 271/139 |
| 4,436,469 | A * | 3/1984 | Kelly | 412/16 |
| 2008/0157462 | A1* | 7/2008 | Ohta | 271/110 |

FOREIGN PATENT DOCUMENTS

| | | | | |
|---|---|---|---|---|
| FR | 1516223 | * | 3/1968 | B65H 3/24 |
| JP | 02198923 A | * | 8/1990 | B65H 1/06 |
| JP | 2011-213448 | | 10/2011 | |

* cited by examiner

*Primary Examiner* — Patrick Cicchino
(74) *Attorney, Agent, or Firm* — Hamre, Schumann, Mueller & Larson, P.C.

(57) ABSTRACT

An inclined type kicker for pushing out a lowermost-layer corrugated cardboard sheet in a plurality of corrugated cardboard sheets stacked in a hopper toward a front gate disposed on the downstream side of a sheet transferring direction in the hopper includes: a push-out face for pushing out the lowermost-layer corrugated cardboard sheet toward a lower end opening side of the front gate in abutment against a rear end of the lowermost-layer corrugated cardboard sheet on the upstream side of the sheet transferring direction; and a rear end lift-up face which is obliquely formed such that the height is gradually increased toward the upstream side of the sheet transferring direction and adapted to lift upward the rear end side of the corrugated cardboard sheet located on the upper layer side of the lowermost-layer corrugated cardboard sheet with an operation of pushing out the lowermost-layer corrugated cardboard sheet.

3 Claims, 5 Drawing Sheets

CORRUGATED CARDBOARD SHEET FEEDER

BACKGROUND

1. Technical Field

The present invention relates to a corrugated cardboard sheet feeder configured to stack a plurality of corrugated cardboard sheets in a hopper, and to push out a lowermost-layer corrugated cardboard sheet among the plurality of corrugated cardboard sheets by a kicker to the side of a lower end opening in a front gate disposed on the downstream side of a sheet transferring direction in the hopper, and to feed and transfer the lowermost-layer corrugated cardboard sheet which has passed through the lower end opening, one by one, to another device (for example, a printer) disposed on the downstream side of the sheet transferring direction.

2. Related Art

In general, a thick corrugated cardboard sheet is frequently used as a container material used as an outer package of a product, and a product name, a product model number, a manufacturer's name and so forth are often printed on a corrugated cardboard sheet before producing a packing box using the corrugated cardboard sheet. In the above-mentioned situation, there is applied a corrugated cardboard sheet feeder adapted to stack the plurality of corrugated cardboard sheets in the hopper almost horizontally and to feed and transfer the lowermost-layer corrugated cardboard sheet among the plurality of corrugated cardboard sheets, one by one, to the printer disposed on the downstream side of the sheet transferring direction.

The corrugated cardboard sheet feeder of the above-mentioned type is available in various structural forms and, for example, many feed-out rollers, endless belts, kickers and so forth are used as a sheet feed-out unit when transferring the lowermost-layer corrugated cardboard sheet, one by one, in the sheet transferring direction. Here, an example using the kicker will be described.

Here, as one example of the corrugated cardboard sheet feeder using the kicker, there is disclosed a sheet feeder used in a corrugated cardboard sheet carton former (see, for example, Patent Literature 1).

Although illustration is omitted here, in the sheet feeder (corresponding to a corrugated cardboard sheet feeder) in the corrugated cardboard sheet carton former disclosed in Patent Literature 1, a hopper adapted to store the plurality of corrugated cardboard sheets is disposed on a mounting table.

In addition, the above-mentioned hopper includes a front gate disposed on the downstream side of the sheet transferring direction in which the corrugated cardboard sheet is to be transferred, and a back guide disposed on the upstream side of the sheet transferring direction opposite to the downstream side of the sheet transferring direction so as to face the front gate leaving a space between the front gate and the back guide.

Then, the plurality of corrugated cardboard sheets are stacked on the mounting table almost horizontally between the front gate and the back guide.

In the above-mentioned case, a lower end opening adapted to allow passage of only one sheet, that is, the lowermost-layer corrugated cardboard sheet among the plurality of corrugated cardboard sheets stacked in the hopper is formed in a lower end of the front gate.

In addition, a belt kicker mechanism with a feed claw part is disposed to be rotatable under the mounting table so as to transfer only the lowermost-layer corrugated cardboard sheet among the plurality of corrugated cardboard sheets stacked on the mounting table by the feed claw part of the belt kicker mechanism integrally with the mounting table toward the downstream side of the sheet transferring direction.

In addition, a sheet pressing mechanism is disposed on an inner upper part of the front gate in order to make such an improvement that a warp of a front end of the corrugated cardboard sheet located on the downstream side of the sheet transferring direction is temporarily straightened by the sheet pressing mechanism to facilitate passage of the front end of the lowermost-layer corrugated cardboard sheet through the front gate.

Further, a grate is disposed on an inner lower part of the back guide so as to be movable upward and downward, and the grate is configured to cause rear end sides of one or more corrugated cardboard sheets located on the upper layer side of the lowermost-layer corrugated cardboard sheet to move upward and downward.

Then, in the sheet feeder so configured as mentioned-above, in general, the total weight of the plurality of corrugated cardboard sheets stacked on the lowermost-layer corrugated cardboard sheet is loaded on the lowermost-layer corrugated cardboard sheet. However, one or more of the plurality of corrugated cardboard sheets located on the upper layer side of the lowermost-layer corrugated cardboard sheet are separated from the lowermost-layer corrugated cardboard sheet while gradually inclining upward from the front gate side toward the back guide side by lifting up the rear end parts of the one or more corrugated cardboard sheets located on the upper layer side of the lowermost-layer corrugated cardboard sheet by the grate, in the middle of transferring the lowermost-layer corrugated cardboard sheet toward the downstream side of the sheet transferring direction by the feed claw part of the belt kicker mechanism. Then, it is possible to reduce frictional resistance and rubbing which would occur between the lowermost-layer corrugated cardboard sheet and the second lowest corrugated cardboard sheet from bottom located on the lowermost-layer corrugated cardboard sheet.

The grate is lowered to a position under the mounting table when the feed claw part of the belt kicker mechanism has been moved to a downstream end of the mounting table.

CITATION LIST

Patent Literature

Patent Literature 1: Japanese Patent Application Laid-Open Publication No. 2011-213448

SUMMARY

In the sheet feeder in the corrugated cardboard sheet carton former disclosed in Patent Literature 1, although it is possible to lift up the rear end sides of the one or more corrugated cardboard sheets located on the upper layer side of the lowermost-layer corrugated cardboard sheet by the grate which is movable upward and downward in the middle of transferring the lowermost-layer corrugated cardboard sheet toward the downstream side of the sheet transferring direction as described above, there are such disadvantages that since a grate lifting mechanism for moving up and down the grate is necessary. Consequently, the configuration of the sheet feeder is complicated and costs much and it requires to control the timing of moving up and down the grate.

Accordingly, an object of the present invention is to provide a corrugated cardboard sheet feeder configured such that, when a plurality of corrugated cardboard sheets are stacked in a hopper, the lowermost-layer corrugated cardboard sheet among the plurality of corrugated cardboard sheets is pushed out toward the side of a lower end opening of a front gate disposed on the downstream side of the sheet transferring direction in the hopper by a kicker, and then, the lowermost-layer corrugated cardboard sheet which has passed through the lower end opening is fed and transferred, one by one, to another device (for example, a printer) disposed on the downstream side of the sheet transferring direction, and then, it becomes possible to lift up rear end sides of one or more corrugated cardboard sheets located on the upper layer side of the lowermost-layer corrugated cardboard sheet by a simple structure without using the grate which is movable upward and downward.

The present invention has been made in view of the above-mentioned disadvantages. One aspect of the present invention is a corrugated cardboard sheet feeder having:

a hopper adapted to store a plurality of corrugated cardboard sheets in a stacked state and including a front gate formed with a lower end opening for passing, one by one, the lowermost-layer corrugated cardboard sheet among the plurality of corrugated cardboard sheets on the downstream side of a sheet transferring direction;

an inclined type kicker including:

a push-out face adapted to push out the lowermost-layer corrugated cardboard sheet toward the lower end opening side of the front gate in abutment against a rear end of the lowermost-layer corrugated cardboard sheet stored in the hopper on the upstream side of the sheet transferring direction; and a rear end lift-up face which is obliquely formed such that the height thereof is gradually increased toward the upstream side of the sheet transferring direction and adapted to lift upward a rear end side of a corrugated cardboard sheet located on the upper layer side of the lowermost-layer corrugated cardboard sheet in association with an operation of pushing out the lowermost-layer corrugated cardboard sheet;

a kicker reciprocation unit adapted to reciprocate the inclined type kicker between a standby position where the inclined type kicker is put on standby on the upstream side of the sheet transferring direction beyond the rear end of the lowermost-layer corrugated cardboard sheet which is in a state before pushed out by the inclined type kicker and a stop position where the inclined type kicker stops after the lowermost-layer corrugated cardboard sheet has been pushed out and the rear end side of the corrugated cardboard sheet located on the upper layer side of the lowermost-layer corrugated cardboard sheet has been lifted upward by the inclined type kicker; and a sheet feed and transfer unit adapted to feed and transfer the lowermost-layer corrugated cardboard sheet which has passed through the lower end opening in the front gate toward another device disposed on the downstream side of the sheet transferring direction.

In addition, the corrugated cardboard sheet feeder according to an embodiment of the present invention may be configured such that the rear end lift-up face of the inclined type kicker includes:

a rear end lift introduction face which is flatly formed with a height lower than a thickness of each corrugated cardboard sheet and gets under a lower surface of the corrugated cardboard sheet located on the upper layer side of the lowermost-layer corrugated cardboard sheet to introduce a lift;

an inclined face adapted to lift up the rear end side of the corrugated cardboard sheet under which the lift has been introduced onto the rear end lift introduction face; and a sheet hold face adapted to hold the rear end side of the corrugated cardboard sheet so lifted up by the inclined face, and the rear end lift-up face, the inclined face and the sheet hold face are formed in turn toward the upstream side of the sheet transferring direction.

In addition, the corrugated cardboard sheer feeder according to an embodiment of the present invention may be configured such that the rear end lift-up faces of the inclined type kicker are plurally formed at intervals along a sheet width direction which is orthogonal to the sheet transferring direction for the lowermost-layer corrugated cardboard sheet and a roller is attached to each of the rear end lift-up faces so as to be rotatable in a direction parallel with the sheet transferring direction in a state of being protruded upward slightly higher than a part of a maximum height which has been inclined upward in the rear end lift-up face.

DETAILED DESCRIPTION

In the following, the corrugated cardboard sheet feeder according to embodiments of the present invention will be described in detail with reference to FIG. 1 to FIG. 5, and FIG. 6A to FIG. 6F.

In the following, description will be made on the assumption that in each of FIG. 1 to FIG. 5 and FIG. 6A to FIG. 6F, an arrow indicating a sheet transferring direction TD denotes an orientation directing from the upstream side toward the downstream side of the sheet transferring direction TD.

A corrugated cardboard sheet feeder according to an embodiment of the present invention is configured such that: when a plurality of corrugated cardboard sheets are stacked in a hopper almost horizontally, a lowermost-layer corrugated cardboard sheet among the plurality of corrugated cardboard sheets is pushed out by a kicker toward the side of a lower end opening of a front gate disposed on the downstream side of the sheet transferring direction TD in the hopper; and the lowermost-layer corrugated cardboard sheet which has passed through the lower end opening is fed and transferred to another device (for example, a printer) disposed on the downstream side of the sheet transferring direction, one by one, and the kicker is formed into the shape of an inclined type kicker including: a push-out face adapted to push out a rear end of the lowermost-layer corrugated cardboard sheet located on the upstream side of the sheet transferring direction TD; and a rear end lift-up face which is inclined upward adjacently to the push-out face, and further rear end sides of one or more corrugated cardboard sheets located on the upper layer side of the lowermost-layer corrugated cardboard sheet are lifted up by the rear end lift-up face of the inclined type kicker in the middle of pushing out the lowermost-layer corrugated cardboard sheet by the push-out face of the inclined type kicker.

Embodiments

Figure 1:
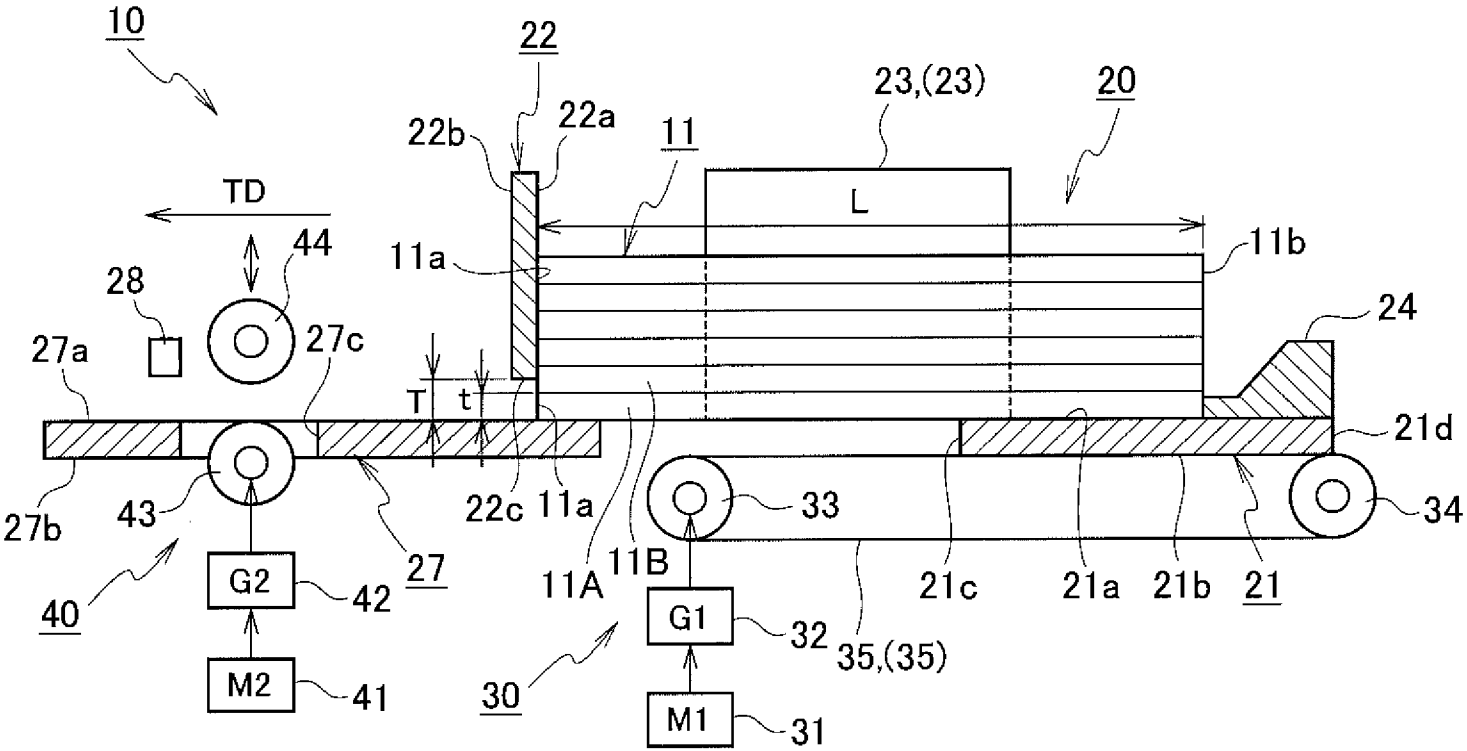
FIG. 1 is a configuration diagram illustrating an example of a general configuration of a corrugated cardboard sheet feeder according to an embodiment of the present invention.

FIG. 1 illustrates an example of a corrugated cardboard sheet feeder 10 according to an embodiment of the present invention in section.

As illustrated in FIG. 1, the corrugated cardboard sheet feeder 10 according to the embodiment of the present invention is configured to be capable of feeding and transferring a plurality of corrugated cardboard sheets 11, one by one, toward, for example, a printer (not illustrated) which is a destination to which the corrugated cardboard sheets are to be fed so as to perform printing, for example, for a packing box in the printer.

In the above-mentioned corrugated cardboard sheet feeder 10, a hopper 20 adapted to store the plurality of corrugated cardboard sheets 11 by stacking the sheets 11 almost horizontally is configured by being surrounded by a sheet mounting member 21, a front gate 22 and one pair of side fences 23 and (23) (not illustrated).

The plurality of corrugated cardboard sheets 11 which are the same as one another in outer size and are each formed into a rectangular shape are stacked almost horizontally on a flat upper surface 21*a* of the above-mentioned sheet mounting member 21. Here, a sheet mounting table that both of the upper surface 21*a* and a lower surface 21*b* are made of flat and rigid metal plates is used as the sheet mounting member 21.

In the above-mentioned case, in the sheet mounting member (hereinafter, noted as the sheet mounting table) 21, a length between a front end 21*c* located on the downstream side of the sheet transferring direction TD and a rear end 21*d* located on the upstream side of the sheet transferring direction TD opposite to the downstream side of the sheet transferring direction Td is set to almost ⅓ of a length L of each corrugated cardboard sheet 11 in the sheet transferring direction TD.

Then, the sheet mounting table 21 is configured to allow stacking of about one hundred corrugated cardboard sheets each having a thickness t of, for example, about 3.0 mm thereon.

In addition, the platy front gate 22 is disposed in front of the sheet mounting table 21 which is located on the downstream side of the sheet transferring direction TD in the hopper 20 vertically to the upper surface 21*a* of the sheet mounting table 21.

The above-mentioned front gate 22 restricts front ends 11*a* of respective corrugated cardboard sheets 11 other than a lowermost-layer corrugated cardboard sheet 11A among the plurality of corrugated cardboard sheets 11 stacked on the sheet mounting table 21 by its own inner surface 22*a* and a non-illustrated printer is disposed on the downstream side of the sheet transferring direction TD beyond its own outer surface 22*b*.

In addition, a lower end opening 22*c* is formed in a lower end of the front gate 22 and is set to a height dimension T (T>t) which is slightly higher than the thickness t of each corrugated cardboard sheet 11 when measured using the upper surface 21*a* of the sheet mounting table 21 as a reference plane. The lower end opening 22*c* is opened to such an extent that the front end 11*a* side of the lowermost-layer corrugated cardboard sheet 11A is separated from the corrugated cardboard sheets located on its upper layer side among the plurality of corrugated cardboard sheets 11 so as to allow passage of only one sheet, that is, only the lowermost-layer corrugated sheet 11A through the lower end opening 22*c* in the sheet transferring direction TD.

In the above-mentioned case, when the thickness t of each corrugated cardboard sheet 11 is, for example, about 3.0 mm, the height dimension T of the lower end opening 22*c* of the front gate 22 is set to, for example, about 4.0 mm.

That is, the height dimension T of the lower end opening 22*c* is set to have a dimension which is larger than the thickness t of each corrugated cardboard sheet 11 and is smaller than 2× the thickness t of each corrugated cardboard sheet 11. That is, the height dimension T meets a relation [t<T<2×t].

Accordingly, passage of a second lowest corrugated cardboard sheet 11B which is located on the upper side of the lowermost-layer corrugated cardboard sheet 11A and the plurality of corrugated cardboard sheets 11 stacked on the second lowest corrugated cardboard sheet 11B through the lower end opening 22*c* of the front gate 22 is not allowed.

The height dimension T of the lower end opening 22*c* of the front gate 22 is made adjustable in accordance with the thickness t of each corrugated cardboard sheet 11.

In addition, the one pair of side fences 23 and (23) (not illustrated) are disposed on both sides of a sheet width direction WD orthogonal to the sheet transferring direction TD of the plurality of corrugated cardboard sheets 11 so as to face each other leaving a space vertically relative to the upper surface 21*a* of the sheet mounting table 21.

The above-mentioned one pair of side fences 23 and (23) restrict the both ends in the sheet width direction WD of the plurality of corrugated cardboard sheets 11 stored in the hopper 20.

The space between the one pair of side fences 23 and (23) is made adjustable in accordance with a width dimension of each corrugated cardboard sheet 11.

In addition, an inclined type kicker 24 which would constitute one of principal parts of the present embodiment is integrally attached onto the sheet mounting table 21 in the vicinity of the rear end 21*d* located on the upstream side of the sheet transferring direction TD opposite to the downstream side of the sheet transferring direction TD on the upper surface 21*a* of the sheet mounting table 21. Description on the inclined type kicker 24 will be made later.

In addition, a platy sheet guide plate 27 is fixedly disposed under the front gate 22. Both of an upper surface 27*a* and a lower surface 27*b* of the sheet guide plate 27 are flattened. The upper surface 27*a* is set almost level with the upper surface 21*a* of the sheet mounting table 21 and the front end 11*a* of the lowermost-layer corrugated cardboard sheet 11A which is located under the front gate 22 is loaded on the upper surface 27*a* when the kicker 24 is put on standby.

In addition, a kicker reciprocation unit 30 adapted to reciprocate the inclined type kicker 24 attached onto the sheet mounting table 21 toward the downstream side of the sheet transferring direction TD and the upstream side of the sheet transferring direction TD opposite to the downstream side of the sheet transferring direction TD is disposed on the lower surface 21*b* side of the sheet mounting table 21.

The above-mentioned kicker reciprocation unit 30 reciprocates the inclined type kicker 24 between a standby position WP where the inclined type kicker 24 is put on standby on the upstream side of the sheet transferring direction TD beyond the rear end 11*b* of the lowermost-layer corrugated cardboard sheet 11A which is in a state before the corrugated cardboard sheet 11A is pushed out by the inclined type kicker 24, and a stop position SP where the inclined type kicker 24 stops after the kicker 24 has pushed out the lowermost-layer corrugated cardboard sheet 11A by moving from the standby position WP toward the downstream side of the sheet transferring direction TD and then has lifted upward rear end 11*b* sides of one or more corrugated cardboard sheets 11 located on the upper layer side of the lowermost-layer corrugated cardboard sheet 11A.

Specifically describing, the kicker reciprocation unit 30 includes a first forwardly and reversely rotating motor 31 (M1), a first reduction gear train 32 (G1) adapted to reduce rotation of the first motor 31, a driving side sprocket 33 connected with the first reduction gear train 32 to perform forward and reverse rotation, a driven side sprocket 34 adapted to rotate by being driven by the driving side sprocket 33 and one pair of chains 35 and (35) (not illustrated) which are wound endlessly between the driving side sprocket 33 and the driven side sprocket 34 to perform forward and reverse rotation and are disposed on both sides of the kicker reciprocation unit 30 oriented in the sheet width direction WD.

In the above-mentioned case, the sheet mounting table 21 to which the inclined type kicker 24 is integrally attached is loaded across the one pair of chains 35 and (35).

Then, as described later in the description on operation, the kicker reciprocation unit 30 is configured such that when the first motor 31 has forwardly rotated in a counterclockwise direction, the inclined type kicker 24 moves from the illustrated standby position WP toward the downstream side of the sheet transferring direction TD integrally with the sheet mounting table 21 via the chains 35 and the lowermost-layer corrugated cardboard sheet 11A is pushed out toward the downstream side of the sheet transferring direction TD passing through the lower end opening 22*c* in the front gate 22 by being pushed out by the inclined type kicker 24, while when the first motor 31 has reversely rotated in a clockwise direction, the inclined type kicker 24 moves toward the upstream side of the sheet transferring direction TD integrally with the sheet mounting table 21 via the chains 35 and returns to the original standby position WP.

Incidentally, although in the present embodiment, description has been made by using the chains 35 which would support the heavy-weighted sheet mounting table 21 as a unit for moving the inclined type kicker 24 integrally with the sheet mounting table 21, a rigid timing belt may be favorably used in place of the chains 35.

In addition, a sheet feed and transfer unit 40 adapted to feed and transfer the lowermost-layer corrugated cardboard sheet 11A which has passed through the lower end opening 22*c* of the front gate 22 toward another device not illustrated (for example, a printer) which is disposed on the downstream side of the sheet transferring direction TD beyond the kicker reciprocation unit 30.

The above-mentioned sheet feed and transfer unit 40 includes a second forwardly rotating motor 41 (M2), a second reduction gear train 42 (G2) adapted to reduce rotation of the second motor 41, a drive roller 43 which forwardly rotates by being connected with the second reduction gear train 42 and is made to face into a through-hole 27*c* formed in the sheet guide plate 27 from the lower surface 27*b* side toward the upper surface 27*a* side and a driven roller 44 which presses against the driver roller 43 from the upper surface 27*a* side of the sheet guide plate 27 so as to freely come into/out of contact with the driver roller 43.

In the above-mentioned case, a sheet transfer roller pair (43, 44) formed by pairing the drive roller 43 with the driven roller 44 is also called a resist roller pair and the resist roller pair corrects a positional displacement of the front end 11*a* of the lowermost-layer corrugated cardboard sheet 11A in the sheet width direction WD.

Then, as described later in the description on operation, the sheet feed and transfer unit 40 is configured to feed and transfer the lowermost-layer corrugated cardboard sheet 11A which has passed through the lower end opening 22*c* of the front gate 22 toward the printer side not illustrated while feeding the corrugated cardboard sheet 11A along the upper surface 27*a* of the sheet guide plate 27 when the second motor 41 has forwardly rotated in the counterclockwise direction.

Further, a sheet end detection sensor 28 is disposed in the downstream vicinity of the resist roller pair formed by paring the drive roller 43 with the driven roller 44 by using a well-known micro-switch, reflection type photosensor or the like so as to detect the front end 11*a* of the lowermost-layer corrugated cardboard sheet 11A which has passed between the drive roller 43 and the driven roller 44 by using the sheet end detection sensor 28.

Here, the inclined type kicker 24 which would constitute one of principal parts of the present embodiment will be described by using FIG. 1 to FIG. 5.

In the present embodiment, as structural forms of the inclined type kicker 24, there are provided inclined type kickers 24A, 24B, 24C and 24D according to first to fourth embodiments, and any one of the kickers according to the embodiments is applicable.

First Embodiment

Figure 2A:
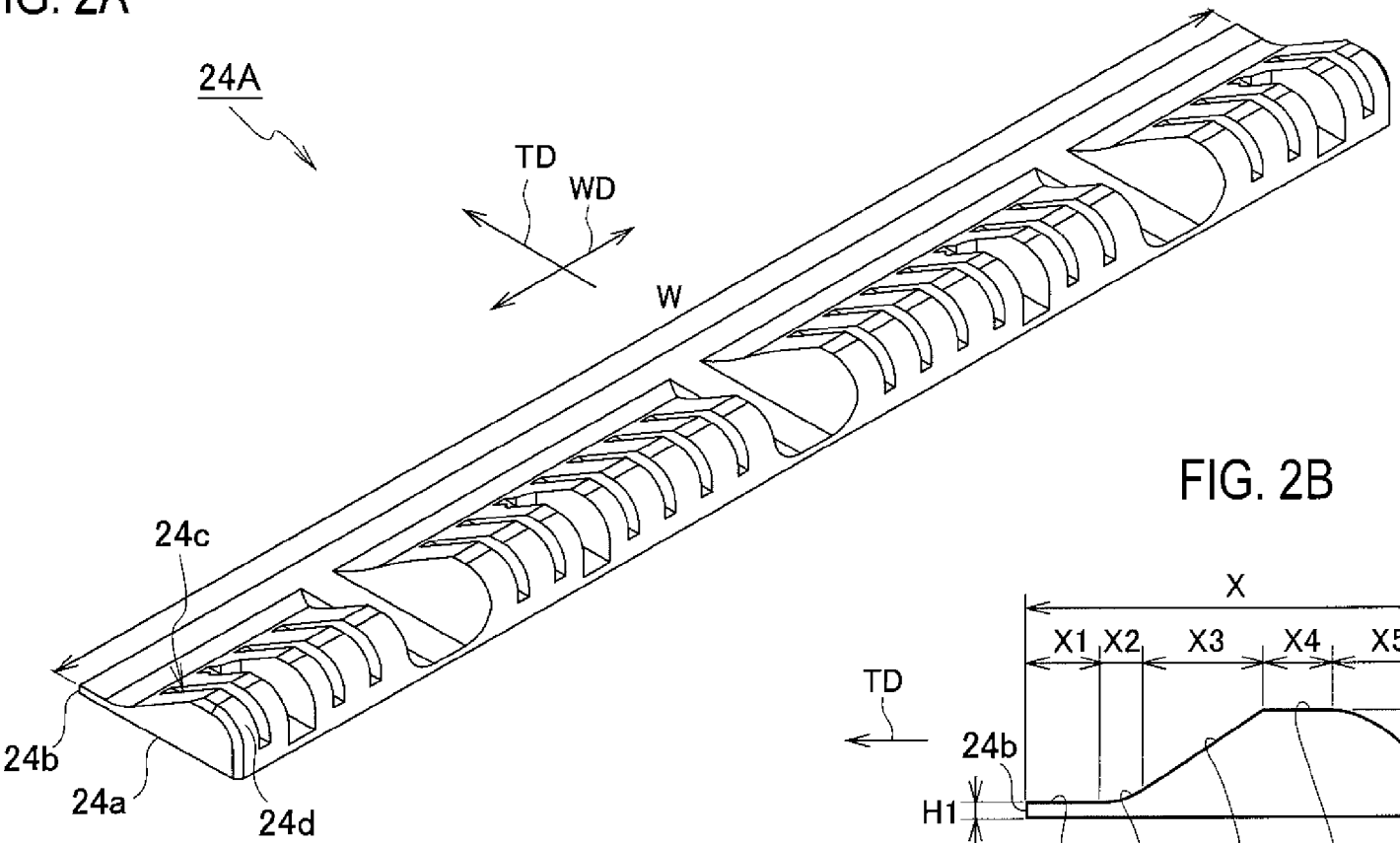
FIG. 2A is a diagram illustrating an example of a first embodiment of an inclined type kicker in the corrugated cardboard sheet feeder according to the embodiment of the present invention, that is, a perspective view of the inclined type kicker.

First, the first embodiment of the inclined kicker in the corrugated cardboard sheet feeder according to the embodiment of the present invention will be described by using FIG. 2A and FIG. 2B. FIG. 2A is a perspective view illustrating an example of the inclined type kicker and FIG. 2B is a side view illustrating an example of the inclined type kicker when viewed from the sheet width direction.

Figure 2B:
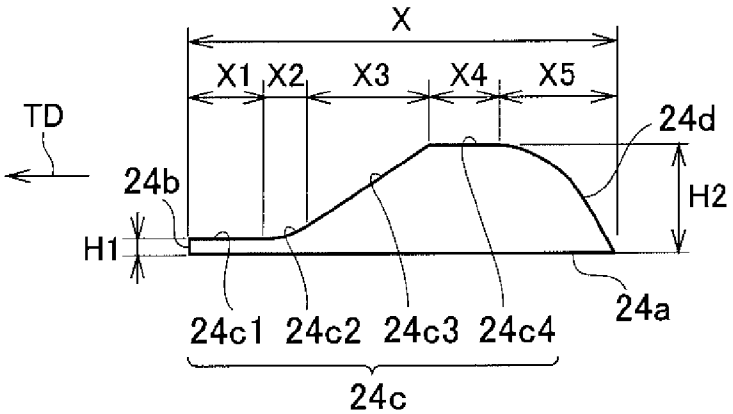
FIG. 2B is a diagram illustrating an example of the first embodiment of the inclined type kicker in the corrugated cardboard sheet feeder according to the embodiment of the present invention, that is, a side view of the inclined type kicker when viewed from a sheet width direction.

First, as illustrated in FIG. 2A and FIG. 2B, a width dimension W of the inclined type kicker 24A according to the first embodiment is made wide corresponding to the width dimension (not illustrated) of each corrugated cardboard sheet 11.

Then, the inclined type kicker 24A according to the first embodiment includes a bottom face 24*a* to be attached onto the upper surface 21*a* of the sheet mounting table 21, a push-out face 24*b* which is formed vertically relative to the bottom face 24*a* so as to have a height H1 which is less than the thickness t of each corrugated cardboard sheet 11, that is, slightly lower than the thickness t and adapted to push out the lowermost-layer corrugated cardboard sheet 11A on the sheet mounting table 21 toward the lower end opening 22*c* side of the front gate 22, a rear end lift-up face 24*c* which is obliquely formed such that its height is gradually increased relative to the bottom face 24*a* toward the upstream side of the sheet transferring direction TD on the side opposite to a pushing-out direction in which the corrugated cardboard sheet 11A is pushed out by the push-out face 24 and is adapted to lift upward the rear end 11*b* sides of one or more corrugated cardboard sheets 11 located on the upper layer side of the lowermost-layer corrugated cardboard sheet 11A in association with an operation of pushing out the lowermost-layer corrugated cardboard sheet 11A, and a rear face 24*d* which is bent into an R-shape.

In the above-mentioned case, the bottom face 24*a* and the push-out face 24*b* of the inclined type kicker 24A according to the first embodiment are formed to be adjacent to each other along the sheet width direction WD, while a plurality of combinations of the rear end lift-up faces 24*c* and the rear faces 24*d* are formed having appropriate widths and at intervals along the sheet width direction WD.

In addition, as illustrated in FIG. 2B in an enlarged form, the rear end lift-up face 24*c* of the inclined type kicker 24A according to the first embodiment includes a rear end lift introduction face 24*c*1, a concavely-curved face 24*c*2 for connection, an inclined face 24*c*3 and a sheet hold face 24*c*4 which are formed adjacently to one another in turn toward the upstream side of the sheet transferring direction TD.

In the above-mentioned case, the above-mentioned rear end lift introduction face 24*c*1 is flatly formed as a first flat face 24*c*1 adjacently to an upper end of the push-out face 24*b* horizontally in parallel with the bottom face 24*a*, by having a height H1 which is less than the thickness t of each corrugated cardboard sheet 11, that is, slightly lower than the thickness t. The rear end lift introduction face 24*c*1 has a function of getting under a lower surface of each of the corrugated cardboard sheets 11 including the second lowest corrugated cardboard sheet 11B located on the upper layer side of the lowermost-layer corrugated cardboard sheet 11A, and introducing a lift under each corrugated cardboard sheet 11 while preventing stack-paper feeding of the second lowest corrugated cardboard sheet 11B which is located directly on the lowermost-layer corrugated cardboard sheet 11A in the sheet transferring direction TD.

Pushing-out of the second lowest corrugated cardboard sheet 11B toward the downstream side of the sheet transferring direction TD is restricted because the front end 11*a* of the second lowest corrugated cardboard sheet 11B abuts against the inner surface 22*a* of the front gate 22. However, in a case where part of the front end 11*a* of the second lowest corrugated cardboard sheet 11B gets into the lower end opening 22*c* of the front gate 22 due to a variation in thickness t among the corrugated cardboard sheets 11, there is danger that stack-paper feeding of the second lowest corrugated cardboard sheet 11B together with the lowermost-layer corrugated cardboard sheet 11A occurs. Therefore, the above-mentioned rear end lift introduction face 24*c*1 is formed in order to avoid stack-paper feeding of the corrugated cardboard sheets 11.

That is, in the rear end lift-up face 24*c* of the inclined type kicker, since the rear end lift introduction face 24*c*1, the inclined face 24*c*3 and the sheet hold face 24*c*4 are formed in turn toward the upstream side of the sheet transferring direction TD and, in particular, the rear end lift introduction face 24*c*1 is flatly formed having the height H which is less than the thickness t of each corrugated cardboard sheet, it is possible to prevent stack-paper feeding of the second lowest corrugated cardboard sheet 11B which is located directly on the lowermost-layer corrugated cardboard sheet 11A when pushing out the lowermost-layer corrugated cardboard sheet 11A.

In addition, the above-mentioned concavely curved face 24*c*2 for connection is formed such that the rear end lift introduction face 24*c*1 and the inclined face 24*c*3 are smoothly brought into adjacent to each other.

In addition, while pushing out the rear end 11*b* of the lowermost-layer corrugated cardboard 11A by the push-out face 24*b* toward the downstream side of the sheet transferring direction TD, the above-mentioned inclined face 24*c*3 is obliquely formed such that the face 24*c*3 lifts up upward the rear end 11*b* sides of the plurality of corrugated cardboard sheets 11 including the second lowest corrugated cardboard sheet 11B and stacked thereon, under which the lift has been introduced onto the rear end lift introduction face 24*c*1, while the push-out face 24*b* moves toward the downstream side of the sheet transferring direction TD.

In addition, the above-mentioned sheet hold face 24*c*4 is flatly formed as a second flat face adjacently to the top of the inclined face 24*c*3 having a maximum height H2 relative to the bottom face 24*a* and has a function of holding the rear end 11*b* sides of one or more corrugated cardboard sheets located on the upper layer side of the lowermost-layer corrugated cardboard sheet 11A which has been lifted up by the inclined face 24*c*3.

Then, when the thickness t of each corrugated cardboard sheet 11 is, for example, about 3.0 mm, the respective dimensions in FIG. 2B are set such that, for example, H1=about 2.5 mm, H2=about 20.0 mm, X1+X2=about 10 mm, X3=about 10 mm, X4=about 5 mm and X5=about 10 mm and therefore a length X in the sheet transferring direction TD of the inclined type kicker 24A according to the first embodiment amounts to about 35 mm.

Second Embodiment

Figure 3A:
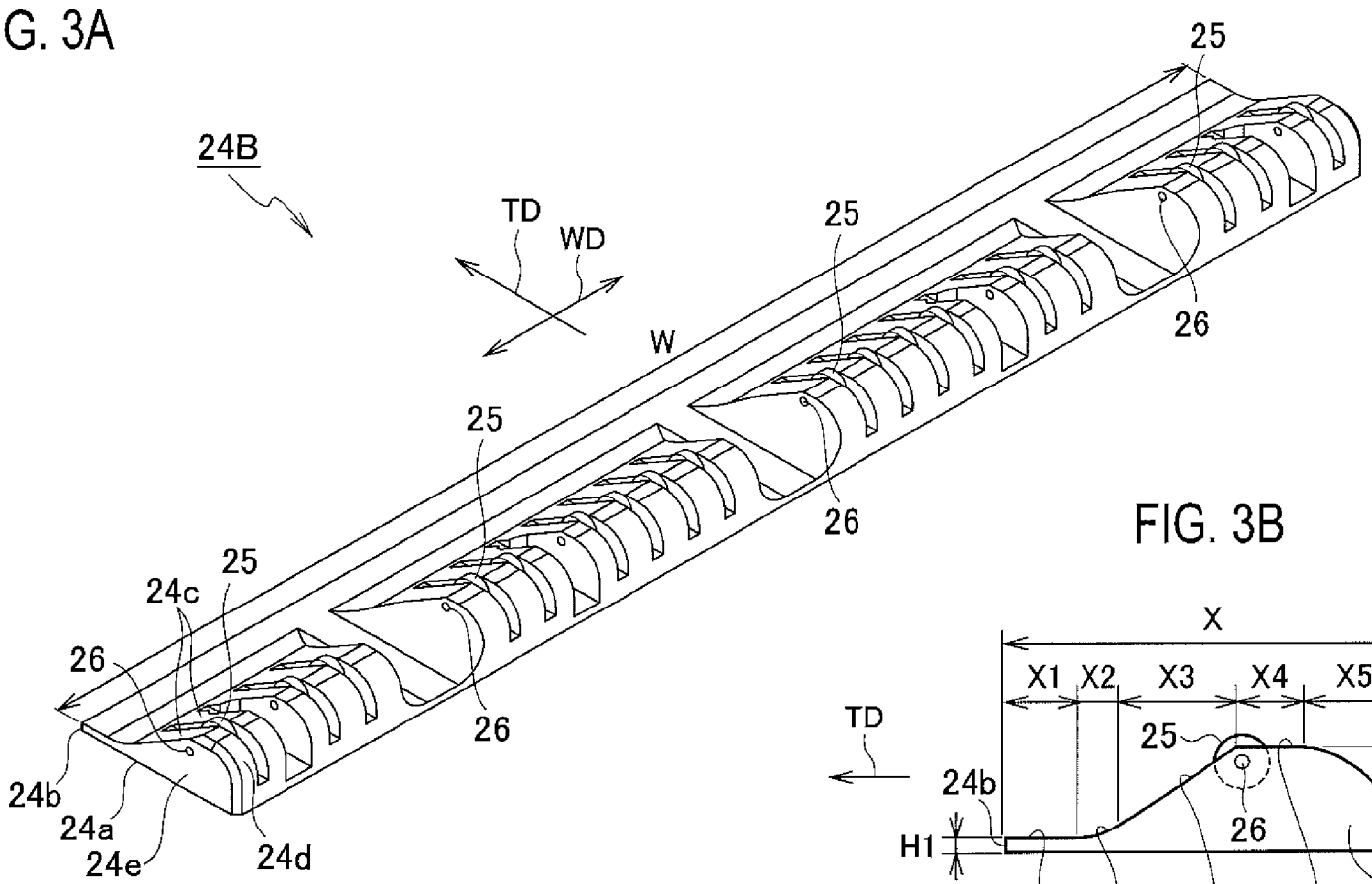
FIG. 3A is a diagram illustrating an example of a second embodiment of the inclined type kicker in the corrugated cardboard sheet feeder according to the embodiment of the present invention, that is, a perspective view of the inclined type kicker.

Next, the second embodiment of the inclined type kicker in the corrugated cardboard sheet feeder according to the embodiment of the present invention will be described using FIG. 3A and FIG. 3B. FIG. 3A is a perspective view illustrating an example of the inclined type kicker and FIG. 3B is a side view illustrating an example of the inclined type kicker when viewed from the sheet width direction.

Figure 3B:
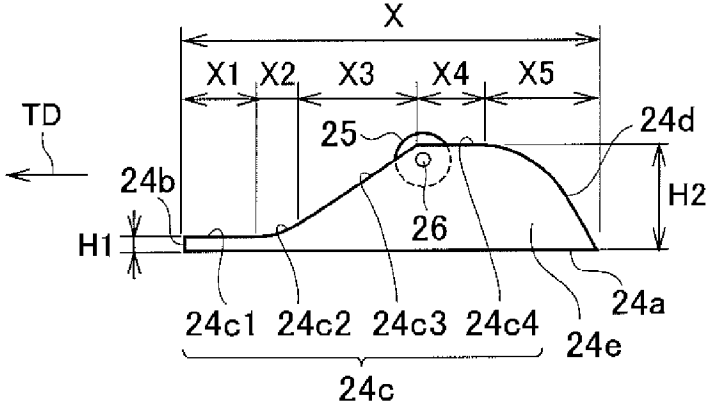
FIG. 3B is a diagram illustrating an example of the second embodiment of the inclined type kicker in the corrugated cardboard sheet feeder according to the embodiment of the present invention, that is, a side view of the inclined type kicker when viewed from the sheet width direction.

The inclined type kicker 24B according to the second embodiment illustrated in FIG. 3A and FIG. 3B has the same configuration as the previously described inclined type kicker 24A according to the first embodiment except some parts. Here, for the convenience of description, the previously described constitutional members are illustrated by assigning the same numerals and constitutional members which are different from the previously described constitutional members will be described by assigning new numerals.

As illustrated in FIG. 3A and FIG. 3B, in the above-mentioned inclined type kicker 24B according to the second embodiment, rollers 25 are respectively attached to side faces 24*e* in the sheet width direction WD of the respective rear end lift-up faces 24*c* which are formed plurally along the sheet width direction WD in the inclined type kicker 24A according to the first embodiment so as to be rotatable via a roller shaft 26. The roller shaft 26 is oriented in the sheet width direction WD.

In the above-mentioned case, the above-mentioned roller 25 is attached to be rotatable in a direction parallel with the sheet transferring direction TD in a state of being projected upward slightly higher than a part of a maximum height which has been inclined upward in the rear end lift-up face 24*c* of the inclined type kicker 24B according to the second embodiment. That is, the roller 25 is attached around the roller shaft 26 which is a rotary shaft oriented in parallel with the sheet width direction WD by being attached via the roller shaft 26.

Thus, even when the weight of the one or more corrugated cardboard sheets 11 located on the upper layer side of the lowermost-layer corrugated cardboard sheet 11A is loaded on the roller 25 in a case where the roller 25 has abutted against the second lowest corrugated cardboard sheet 11B which has been lifted upward by the inclined type kicker 24B according to the second embodiment upon movement of the inclined type kicker 24B according to the second embodiment, it is possible to reduce resistance load exerted onto the inclined type kicker 24B according to the second embodiment upon movement by rotation of the roller 25.

Third Embodiment

Figure 4:
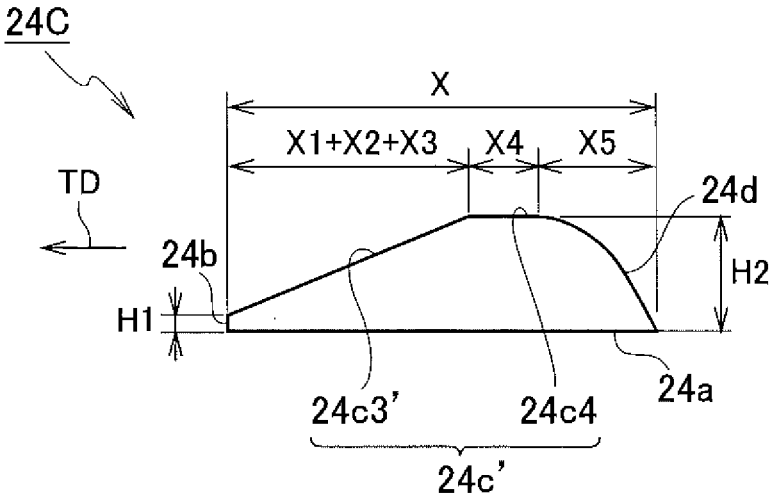
FIG. 4 is a diagram illustrating an example of a third embodiment of the inclined type kicker in the corrugated cardboard sheet feeder according to the embodiment of the present invention, that is, a side view of the inclined type kicker when viewed from the sheet width direction.

Next, the third embodiment of the inclined type kicker in the corrugated cardboard sheet feeder according to the embodiment of the present invention will be described using FIG. 4. FIG. 4 is a side view illustrating an example of the inclined type kicker when viewed from the sheet width direction.

The inclined type kicker 24C according to the third embodiment illustrated in FIG. 4 has the same configuration as the inclined type kicker 24A according to the first embodiment which has been previously described above except several parts. Here, points different from those of the inclined type kicker 24A according to the first embodiment will be described by using only the side view illustrated in FIG. 4.

As illustrated in FIG. 4, the above-mentioned inclined type kicker 24C according to the third embodiment includes the bottom face 24*a*, the push-out face 24*b*, a rear end lift-up face 24*c*' and the rear face 24*d* and only the rear end lift-up face 24*c*' is formed for the purpose of achieving simplification relative to the rear end lift-up face 24*c* of the previously described inclined type kicker 24A according to the first embodiment.

That is, the rear end lift-up face 24*c*' of the above-mentioned inclined type kicker 24C according to the third embodiment includes an inclined face 24*c*3' which has been inclined such that the height is gradually increased from the upper end of the push-out face 24*b* toward the upstream side of the sheet transferring direction TD and finally reaches the maximum height H2 and the sheet hold face 24*c*4 which has been flatly formed having the maximum height H2 relative to the bottom face 24*a*.

Then, the above-mentioned inclined face 24*c*3' is obliquely formed so as to lift upward the rear end 11*b* sides of the one or more corrugated cardboard sheets 11 located on the upper layer side of the lowermost-layer corrugated cardboard sheet 11A with movement of the push-out face 24*b* toward the downstream side of the sheet transferring direction TD in the middle of pushing out the rear end 11*b* of the lowermost-layer corrugated cardboard sheet 11A toward the downstream side of the sheet transferring direction TD by the push-out face 24*b*.

In the above-mentioned case, as described above, pushing out of the second lowest corrugated cardboard sheet 11B which is located directly on the lowermost-layer corrugated cardboard sheet 11A is restricted toward the downstream side of the sheet transferring direction TD, because the front end 11*a* of the corrugated cardboard sheet 11B abuts against the inner face 22*a* of the front gate 22. Owing to the above, even when the rear end 11*b* of the second lowest corrugated cardboard sheet 11B abuts against the inclined face 24*c*3' in the middle of pushing out the lowermost-layer corrugated cardboard sheet 11A by the push-out face 24*b* of the inclined type kicker 24C according to the third embodiment, the second lowest corrugated cardboard sheet 11B is not generally pushed out toward the downstream side of the sheet transferring direction TD and therefore simplification of the rear end lift-up face 24*c*' of the inclined type kicker 24C according to the third embodiment does not cause trouble.

Then, when the thickness t of each corrugated cardboard sheet 11 is, for example, about 3.0 mm, the respective dimensions in FIG. 4 are set such that, for example, H1=about 2.5 mm, H2=about 20.0 mm, X1+X2+X3=about 20 mm, X4=about 5 mm, and X5=about 10 mm and therefore the length X in the sheet transferring direction TD of the inclined type kicker 24C according to the third embodiment amounts to about 35 mm.

Fourth Embodiment

Figure 5:
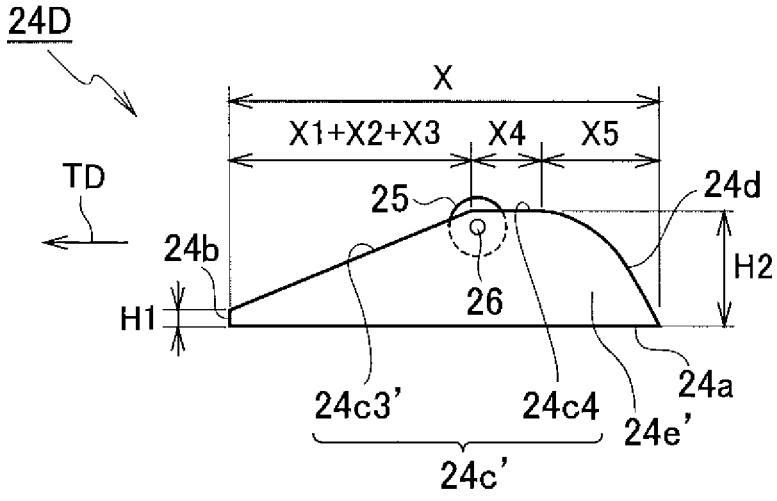
FIG. 5 is a diagram illustrating an example of a fourth embodiment of the inclined type kicker in the corrugated cardboard sheet feeder according to the embodiment of the present invention, that is, a side view of the inclined type kicker when viewed from the sheet width direction.

Next, the fourth embodiment of the inclined type kicker in the corrugated cardboard sheet feeder according to the embodiment of the present invention will be described using FIG. 5. FIG. 5 is a side view illustrating an example of the inclined type kicker when viewed from the sheet width direction.

The inclined type kicker 24D according to the fourth embodiment illustrated in FIG. 5 is different from the inclined type kicker 24C according to the third embodiment only in the point that a roller 25 is attached to a side face 24*e*' in the sheet width direction WD of each of the end lift-up faces 24*c*' which are plurally formed along the sheet width direction WD in the inclined type kicker 24C according to the third embodiment to be rotatable via the roller shaft 26. Since the function of the roller 25 is the same as that of the roller 25 disposed in the previously described inclined type kicker 24B according to the second embodiment, description thereof is omitted here.

[Operation of Corrugated Cardboard Sheet Feeder 10]

An operation of the so configured corrugated cardboard sheet feeder 10 according to the embodiment of the present invention will be described in order of operation using FIG. 6A to FIG. 6F. FIG. 6A to FIG. 6F illustrate examples of a part of a reciprocating operation for the inclined type kicker in turn.

In FIG. 6A to FIG. 6F, illustration of the one pair of side fences 23 and (23) illustrated in FIG. 1 is omitted. In addition, in FIG. 6A to FIG. 6F, an example of a case where the form of the inclined type kicker 24A according to the first embodiment previously described using FIG. 2A and FIG. 2B has been applied as the inclined type kicker 24 will be described. However, since even in a case where any of the embodiments of the inclined type kickers 24B, 24C and 24D from the second embodiment to the fourth embodiment illustrated in FIG. 3A, FIG. 3B, FIG. 4 and FIG. 5 has been applied, the kicker operates almost similarly to the form of the inclined type kicker 24A according to the first embodiment, description thereof is omitted.

Figure 6A:
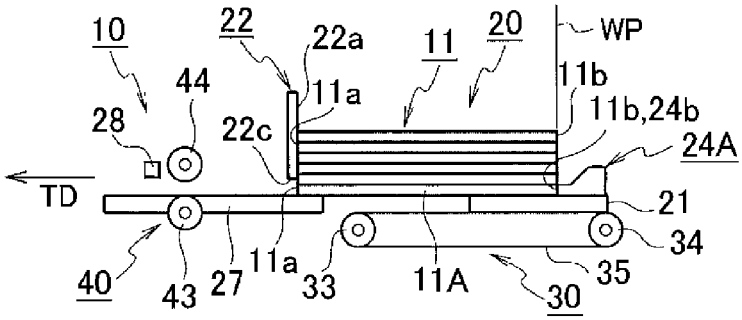
FIG. 6A is an operational diagram illustrating an example of an operation of the corrugated cardboard sheet feeder according to the embodiment of the present invention.

First, when the corrugated cardboard sheet feeder 10 according to the embodiment reaches a standby state (an initial state), the plurality of corrugated cardboard sheets 11 are stacked almost horizontally on the sheet mounting table 21 in the hopper 20 as illustrated in FIG. 6A.

Then, the front end 11*a* of each of the corrugated cardboard sheets 11 other than the lowermost-layer corrugated cardboard sheet 11A among the plurality of corrugated cardboard sheets 11 abuts against the inner face 22*a* of the front gate 22 to be restricted in position and the front end 11*a* of the lowermost-layer corrugated cardboard sheet 11A is loaded on the sheet guide plate 27 while facing the lower end opening 22*c* of the front gate 22.

In addition, in the above-mentioned situation, the kicker reciprocation unit 30 disposed under the sheet mounting table 21 is in a driving stop state. Therefore, the chain 35 wound on the driving side sprocket 33 and the driven side sprocket 34 which configure the kicker reciprocation unit 30 is in a rotation stop state and accordingly the sheet mounting table 21 loaded on the chain 35 and the inclined type kicker 24A according to the first embodiment attached onto the sheet mounting table 21 are on standby at illustrated standby positions WP.

At that time, the push-out face 24*b* of the inclined type kicker 24A maintains a state of abutting against the rear end 11*b* of the lowermost-layer corrugated cardboard sheet 11A. On the other hand, the rear ends 11*b* of the one or more corrugated cardboard sheets 11 located on the upper layer side of the lowermost-layer corrugated cardboard sheet 11A are separated from the inclined type kicker 24A.

In addition, also the sheet feed and transfer unit 40 which is disposed along the sheet guide plate 27 on the downstream side of the sheet transferring direction TD beyond the kicker reciprocation unit 30 is in the driving stop state. Therefore, the drive roller 43 of the sheet feed and transfer unit 40 is at a standstill and the driven roller 44 which is driven by the drive roller 43 is separated from the drive roller 43.

Figure 6B:
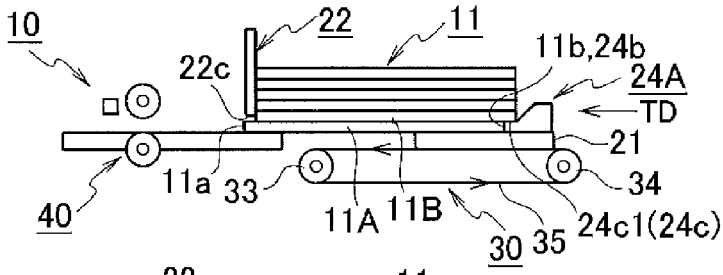
FIG. 6B is an operational diagram illustrating an example of the operation of the corrugated cardboard sheet feeder according to the embodiment of the present invention.

Subsequently, when the chain 35 which is wound on the driving side sprocket 33 and the driven side sprocket 34 which configure the kicker reciprocation unit 30 is forwardly rotated in the counterclockwise direction, the inclined type kicker 24A starts moving toward the downstream side of the sheet transferring direction TD integrally with the sheet mounting table 21 with rotation of the chain 35. Then, the push-out face 24*b* of the inclined type kicker 24A pushes out the rear end 11*b* of the lowermost-layer corrugated cardboard sheet 11A toward the downstream side of the sheet transferring direction TD. Therefore, only the front end 11*a* of the lowermost-layer corrugated cardboard sheet 11A enters the lower end opening 22*c* of the front gate 22 as illustrated in FIG. 6B.

Then, the lift of the rear end 11*b* of the second lowest corrugated cardboard sheet 11B is introduced by the rear end lift introduction face 24*c*1 in the rear end lift-up face 24*c* of the inclined type kicker 24A with movement of the push-out face 24*b* of the inclined type kicker 24A toward the downstream side of the sheet transferring direction TD, and the lift of the rear ends 11*b* of the plurality of corrugated cardboard sheets 11 stacked on the upper layer including the second lowest corrugated cardboard sheet 11B is also introduced.

In addition, since the front end 11*a* of the lowermost-layer corrugated cardboard sheet 11A does not yet reach the sheet feed and transfer unit 40 still at this stage, the sheet feed and transfer unit 40 is in the driving stop state.

Figure 6C:
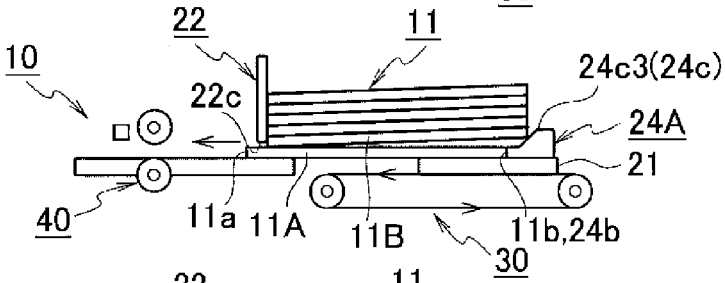
FIG. 6C is an operational diagram illustrating an example of the operation of the corrugated cardboard sheet feeder according to the embodiment of the present invention.

Subsequently, when the inclined type kicker 24A keeps moving toward the downstream side of the sheet transferring direction TD integrally with the sheet mounting table 21 by the kicker reciprocation unit 30 to further move the rear end 11*b* of the lowermost-layer corrugated cardboard sheet 11A by the push-out face 24*b* of the inclined type kicker 24A a little toward the downstream side of the sheet transferring direction TD from the state illustrated in FIG. 6B, the front end 11*a* of the lowermost-layer corrugated cardboard sheet 11A passes through the lower end opening 22*c* of the front gate 22 as illustrated in FIG. 6C.

In addition, the rear end 11*b* sides of the one or more corrugated cardboard sheets 11 located on the upper layer side of the lowermost-layer corrugated cardboard sheet 11A are lifted upward by the inclined face 24*c*3 in the rear end lift-up face 24*c* of the inclined type kicker 24A with movement of the inclined type kicker 24A toward the downstream side of the sheet transferring direction TD.

In addition, since the front end 11*a* of the lowermost-layer corrugated cardboard sheet 11A does not yet reach the sheet feed and transfer unit 40 also at this stage, the sheet feed and transfer unit 40 is in the driving stop state.

Figure 6D:
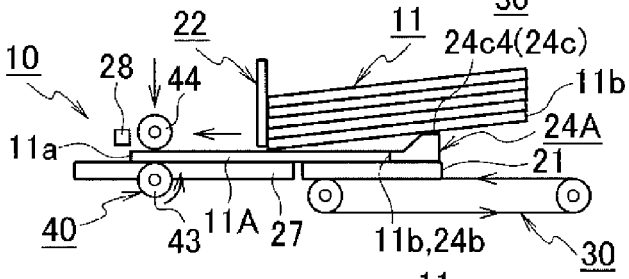
FIG. 6D is an operational diagram illustrating an example of the operation of the corrugated cardboard sheet feeder according to the embodiment of the present invention.

Subsequently, when the inclined type kicker 24A keeps moving further toward the downstream side of the sheet transferring direction TD integrally with the sheet mounting table 21 by the kicker reciprocation unit 30 and the push-out face 24*b* of the inclined type kicker 24A pushes out the rear end 11*b* of the lowermost-layer corrugated cardboard sheet 11A further toward the downstream side of the sheet transferring direction TD, the rear end 11*b* sides of the one or more corrugated cardboard sheets 11 located on the upper layer side of the lowermost-layer corrugated cardboard sheet 11A are held on the sheet hold face 24*c*4 in the rear end lift-up face 24*c* of the inclined type kicker 24A in a state of being lifted upward as illustrated in FIG. 6D.

On the other hand, the front end 11*a* of the lowermost-layer corrugated cardboard sheet 11A enters between the drive roller 43 and the driven roller 44 of the sheet feed and transfer unit 40 while being fed along the sheet guide plate 27.

Then, when the sheet end detection sensor 28 has detected that the front end 11*a* of the lowermost-layer corrugated cardboard sheet 11A has entered between the drive roller 43 and the driven roller 44, the drive roller 43 of the sheet feed and transfer unit 40 is forwardly rotated in the counterclockwise direction and the driven roller 44 is brought into press contact with the drive roller 43 with the lowermost-layer corrugated cardboard sheet 11A interposed.

Figure 6E:
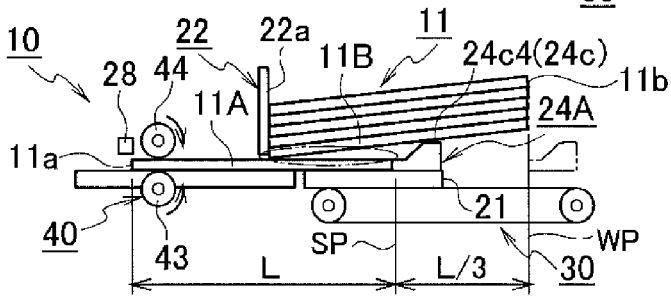
FIG. 6E is an operational diagram illustrating an example of the operation of the corrugated cardboard sheet feeder according to the embodiment of the present invention.

Subsequently, when driving of the kicker reciprocation unit 30 is stopped at start of transfer of the front end 11*a* side of the lowermost-layer corrugated cardboard sheet 11A with the front end 11*a* nipped between the drive roller 43 and the driven roller 44 of the sheet feed and transfer unit 40, then the inclined type kicker 24A stops movement toward the downstream side of the sheet transferring direction TD integrally with the sheet mounting table 21 as illustrated in FIG. 6E.

At that time, since the rear end 11*b* sides of the one or more corrugated cardboard sheets 11 located on the upper layer side of the lowermost-layer corrugated cardboard sheet 11A are held on the sheet hold face 24*c*4 in the rear end lift-up face 24*c* of the inclined type kicker 24A in a state of being lifted upward, and hence a gap generated between the lowermost-layer corrugated cardboard sheet 11A and the second lowest corrugated cardboard sheet 11B is gradually increased from the front end 11*a* sides toward the rear end 11*b* sides. Consequently, the front end 11*a* sides of the plurality of corrugated cardboard sheets 11 stacked on the upper layer of the second lowest corrugated cardboard sheet 11B, including the second lowest corrugated cardboard sheet 11B, are brought into abutment against the inner face 22*a* of the front gate 22, and the rear end 11*b* sides are lifted up, and as a result the corrugated cardboard sheets 11 are inclined.

Owing to the above, the frictional resistance generated between the lowermost-layer corrugated cardboard sheet 11A and the second lowest corrugated cardboard sheet 11B which is located directly on the corrugated cardboard sheet 11A is reduced and rubbing occurring between the corrugated cardboard sheets 11A and 11B is also reduced, and therefore the surface of the lowermost-layer corrugated cardboard sheet 11A is not damaged and paper dust caused by rubbing is not generated. Accordingly, it is possible to feed and transfer the lowermost-layer corrugated cardboard sheet 11A toward the printer not illustrated at a high speed by increasing transferring force for the lowermost-layer corrugated cardboard sheet 11A.

Further, the loads of the one or more corrugated cardboard sheets 11 located on the upper layer side of the lowermost-layer corrugated cardboard sheet 11A are not exerted onto the front end 11*a* side of the lowermost-layer corrugated cardboard sheet 11A located on the downstream side of the sheet transferring direction. Accordingly, it is possible to reduce a driving load on the sheet feed and transfer unit 40 which transfers the lowermost-layer corrugated cardboard sheet 11A which has passed through the front gate 22 toward the downstream side of the sheet transferring direction TD.

In the above-mentioned case, when L is a length of each corrugated cardboard sheet 11 in the sheet transferring direction TD, a moving distance over which the inclined type kicker 24A moves from the standby position WP to the stop position SP in a case where the inclined type kicker 24A has stopped at the illustrated stop position SP when the front end 11*a* of the lowermost-layer corrugated cardboard sheet 11A has reached the sheet feed and transfer unit 40 is set to about ⅓ of the length L of the lowermost-layer corrugated cardboard sheet 11A.

Owing to the above, it is possible to hold the one or more corrugated cardboard sheets 11 held on the sheet hold face 24*c*4 in the rear end lift-up face 24*c* of the inclined type kicker 24A in an inclined state without losing a balance during movement of the inclined type kicker 24A.

Figure 6F:
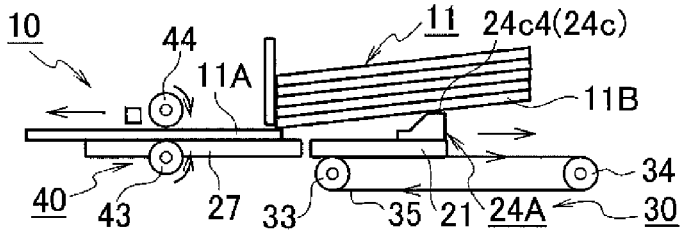
FIG. 6F is an operational diagram illustrating an example of the operation of the corrugated cardboard sheet feeder according to the embodiment of the present invention.

Subsequently, the lowermost-layer corrugated cardboard sheet 11A is transferred toward the printer not illustrated by the drive roller 43 and the driven roller 44 of the sheet feed and transfer unit 40 while feeding the corrugated cardboard sheet 11A along the sheet guide plate 27 as illustrated in FIG. 6F.

On the other hand, when the chain 35 which is wound around the driving side sprocket 33 and the driven side sprocket 34 configuring the kicker reciprocation unit 30 is reversely rotated in the clockwise direction, the inclined type kicker 24A starts moving toward the upstream side of the sheet transferring direction TD opposite to the downstream side of the sheet transferring direction TD integrally with the sheet mounting table 21 with rotation of the chain 35.

At that time, the inclined type kicker 24A returns to the standby position WP with the sheet hold face 24*c*4 in the rear end lift-up face 24*c* of the inclined type kicker 24A in contact with the second lowest corrugated cardboard sheet 11B. Therefore, the second lowest corrugated cardboard sheet 11B is separated from the sheet hold face 24*c* and turns to the next lowermost-layer corrugated cardboard sheet when the inclined type kicker 24A has returned to the standby position WP and thereafter the processes in FIG. 6A to FIG. 6F are repetitively performed.

Then, when the inclined type kicker 24A has returned to the standby position WP, the both ends in the sheet width direction WD of the plurality of corrugated cardboard sheets 11 stacked on the upper layer of the second lowest corrugated cardboard sheet 11B, including the second lowest corrugated cardboard sheet 11B, are restricted by the one pair of side fences 23 and (23) illustrated in FIG. 1, and the corrugated cardboard sheets 11 return to the standby state. That is, since the plurality of the corrugated cardboard sheets 11 stacked on the upper layer return to the standby state which is suited to repetitively perform the processes in FIG. 6A to FIG. 6E when the inclined type kicker 24A has returned to the standby position WP, it becomes possible to push out the corrugated cardboard sheet 11 repetitively and stably.

According to the corrugated cardboard sheet feeder 10 according to the embodiment which has been described in detail hereinabove, the inclined type kicker 24 adapted to push out the lowermost-layer corrugated cardboard sheet 11A among the plurality of corrugated cardboard sheets 11 stacked in the hopper 20 toward the front gate 22 side disposed on the downstream side of the sheet transferring direction TD in the hopper 20 includes: the push-out face 24*b* adapted to push out the lowermost-layer corrugated cardboard sheet 11A toward the lower end opening 22*c* side of the front gate 22 in abutment against the rear end 11*b* of the lowermost-layer corrugated cardboard sheet 11A located on the upstream side of the sheet transferring direction TD; and the rear end lift-up face 24*c* which is obliquely formed such that the height is gradually increased toward the upstream side of the sheet transferring direction TD and is adapted to lift upward the rear end 11*b* sides of the one or more corrugated cardboard sheets 11 located on the upper layer side of the lowermost-layer corrugated cardboard sheet 11A in association with the operation of pushing out the lowermost-layer corrugated cardboard sheet 11A. Therefore, it is not necessary to dispose such a grate which is movable upward and downward as described in Related Art and it is possible to lift upward the rear end 11*b* sides of the one or more corrugated cardboard sheets 11 located on the upper layer side of the lowermost-layer corrugated cardboard sheet 11A only by the inclined type kicker 24. Consequently, the structure of the corrugated cardboard sheet feeder 10 is simplified, then it is possible to provide the corrugated cardboard sheet feeder 10 at a low cost and to readily control the reciprocating operation of the inclined type kicker 24.

While embodiments of the present invention have been described hereinabove, these embodiments are merely illustration described for the purpose of facilitating the understanding of the present invention, and the present invention is not limited to the embodiments. The technical scope of the present invention is not limited to the specific technical matters disclosed in the embodiments but includes various modifications, changes, alternative techniques, and the like which can readily be conceived therefrom.

The present patent application claims the priority based on Japanese Patent Application No. 2013-156412 filed on Jul. 29, 2013 and the entire content thereof is incorporated into the present specification by reference.

INDUSTRIAL APPLICABILITY

According to the corrugated cardboard sheet feeder according to the embodiment of the present invention, the inclined type kicker adapted to push out the lowermost-layer corrugated cardboard sheet among the plurality of corrugated cardboard sheets stacked in the hopper toward the front gate disposed on the downstream side of the sheet transferring direction in the hopper includes: the push-out face adapted to push out the lowermost-layer corrugated cardboard sheet toward the side of the lower end opening of the front gate in abutment against the rear end of the lowermost-layer corrugated cardboard sheet located on the upstream side of the sheet transferring direction; and the rear end lift-up face which is obliquely formed such that the height is gradually increased toward the upstream side of the sheet transferring direction and is adapted to lift upward the rear end sides of the one or more corrugated cardboard sheets located on the upper layer side of the lowermost-layer corrugated cardboard sheet in association with the operation of pushing out the lowermost-layer corrugated cardboard sheet. Therefore, it is possible to lift upward the rear end sides of the one or more corrugated cardboard sheets located on the upper layer side of the lowermost-layer corrugated cardboard sheet only by the inclined type kicker. Consequently, the structure of the corrugated cardboard sheet feeder is simplified, then it is possible to provide the corrugated cardboard sheet feeder at a low cost and to readily control the reciprocating operation of the inclined type kicker.

What is claimed is:

1. A corrugated cardboard sheet feeder comprising:

a hopper adapted to store a plurality of corrugated cardboard sheets in a stacked state and including a front gate formed with a lower end opening for passing, one by one, a lowermost-layer corrugated cardboard sheet among the plurality of corrugated cardboard sheets on a downstream side of a sheet transferring direction;

an inclined type kicker including:

a push-out face adapted to push out the lowermost-layer corrugated cardboard sheet toward the lower end opening side of the front gate in abutment against a rear end of the lowermost-layer corrugated cardboard sheet stored in the hopper on an upstream side of the sheet transferring direction; and a rear end lift-up face which is obliquely formed such that the height thereof is gradually increased toward the upstream side of the sheet transferring direction and adapted to lift upward a rear end side of a corrugated cardboard sheet located on the upper layer side of the lowermost-layer corrugated cardboard sheet in association with an operation of pushing out the lowermost-layer corrugated cardboard sheet;

a kicker reciprocation unit adapted to reciprocate the inclined type kicker between a standby position where the inclined type kicker is put on standby on the upstream side of the sheet transferring direction beyond the rear end of the lowermost-layer corrugated cardboard sheet which is in a state before pushed out by the inclined type kicker and a stop position where the inclined type kicker stops after the lowermost-layer corrugated cardboard sheet has been pushed out and the rear end side of the corrugated cardboard sheet located on the upper layer side of the lowermost-layer corrugated cardboard sheet has been lifted upward by the inclined type kicker; and a sheet feed and transfer unit adapted to feed and transfer the lowermost-layer corrugated cardboard sheet which has passed through the lower end opening in the front gate toward another device disposed on the downstream side of the sheet transferring direction, wherein the rear end lift-up face of the inclined type kicker includes:

a rear end lift introduction face which is flatly formed with a height lower than a thickness of each corrugated cardboard sheet and gets under a lower surface of the corrugated cardboard sheet located on the upper layer side of the lowermost-layer corrugated cardboard sheet to introduce a lift;

an inclined face adapted to lift up the rear end side of the corrugated cardboard sheet under which the lift has been introduced onto the rear end lift introduction face; and a sheet hold face adapted to hold the rear end side of the corrugated cardboard sheet so lifted up by the inclined face, and wherein the rear end lift introduction face, the inclined face and the sheet hold face are formed in turn toward the upstream side of the sheet transferring direction.

2. A corrugated cardboard sheet feeder comprising:

a hopper adapted to store a plurality of corrugated cardboard sheets in a stacked state and including a front gate formed with a lower end opening for passing, one by one, a lowermost-layer corrugated cardboard sheet among the plurality of corrugated cardboard sheets on a downstream side of a sheet transferring direction;

an inclined type kicker including:

a push-out face adapted to push out the lowermost-layer corrugated cardboard sheet toward the lower end opening side of the front gate in abutment against a rear end of the lowermost-layer corrugated cardboard sheet stored in the hopper on an upstream side of the sheet transferring direction; and a rear end lift-up face which is obliquely formed such that the height thereof is gradually increased toward the upstream side of the sheet transferring direction and adapted to lift upward a rear end side of a corrugated cardboard sheet located on the upper layer side of the lowermost-layer corrugated cardboard sheet in association with an operation of pushing out the lowermost-layer corrugated cardboard sheet;

a kicker reciprocation unit adapted to reciprocate the inclined type kicker between a standby position where the inclined type kicker is put on standby on the upstream side of the sheet transferring direction beyond the rear end of the lowermost-layer corrugated cardboard sheet which is in a state before pushed out by the inclined type kicker and a stop position where the inclined type kicker stops after the lowermost-layer corrugated cardboard sheet has been pushed out and the rear end side of the corrugated cardboard sheet located on the upper layer side of the lowermost-layer corrugated cardboard sheet has been lifted upward by the inclined type kicker; and a sheet feed and transfer unit adapted to feed and transfer the lowermost-layer corrugated cardboard sheet which has passed through the lower end opening in the front gate toward another device disposed on the downstream side of the sheet transferring direction, wherein the rear end lift-up faces of the inclined type kicker are plurally formed at intervals along a sheet width direction which is orthogonal to the sheet transferring direction for the lowermost-layer corrugated cardboard sheet and a roller is attached to each of the rear end lift-up faces so as to be rotatable in a direction parallel with the sheet transferring direction in a state of being protruded upward slightly higher than a part of a maximum height which has been inclined upward in the rear end lift-up face.

3. A corrugated cardboard sheet feeder comprising:

a hopper adapted to store a plurality of corrugated cardboard sheets in a stacked state and including a front gate formed with a lower end opening for passing, one by one, a lowermost-layer corrugated cardboard sheet among the plurality of corrugated cardboard sheets on a downstream side of a sheet transferring direction;

an inclined type kicker including:

a push-out face adapted to push out the lowermost-layer corrugated cardboard sheet toward the lower end opening side of the front gate in abutment against a rear end of the lowermost-layer corrugated cardboard sheet stored in the hopper on an upstream side of the sheet transferring direction; and a rear end lift-up face which is obliquely formed such that the height thereof is gradually increased toward the upstream side of the sheet transferring direction and adapted to lift upward a rear end side of a corrugated cardboard sheet located on the upper layer side of the lowermost-layer corrugated cardboard sheet in association with an operation of pushing out the lowermost-layer corrugated cardboard sheet;

a kicker reciprocation unit adapted to reciprocate the inclined type kicker between a standby position where the inclined type kicker is put on standby on the upstream side of the sheet transferring direction beyond the rear end of the lowermost-layer corrugated cardboard sheet which is in a state before pushed out by the inclined type kicker and a stop position where the inclined type kicker stops after the lowermost-layer corrugated cardboard sheet has been pushed out and the rear end side of the corrugated cardboard sheet located on the upper layer side of the lowermost-layer corrugated cardboard sheet has been lifted upward by the inclined type kicker; and a sheet feed and transfer unit adapted to feed and transfer the lowermost-layer corrugated cardboard sheet which has passed through the lower end opening in the front gate toward another device disposed on the downstream side of the sheet transferring direction, wherein the rear end lift-up face of the inclined type kicker includes:

a rear end lift introduction face which is flatly formed with a height lower than a thickness of each corrugated cardboard sheet and gets under a lower surface of the corrugated cardboard sheet located on the upper layer side of the lowermost-layer corrugated cardboard sheet to introduce a lift;

an inclined face adapted to lift up the rear end side of the corrugated cardboard sheet under which the lift has been introduced onto the rear end lift introduction face; and a sheet hold face adapted to hold the rear end side of the corrugated cardboard sheet so lifted up by the inclined face, the rear end lift introduction face, the inclined face and the sheet hold face are formed in turn toward the upstream side of the sheet transferring direction, and the rear end lift-up faces of the inclined type kicker are plurally formed at intervals along a sheet width direction which is orthogonal to the sheet transferring direction for the lowermost-layer corrugated cardboard sheet and a roller is attached to each of the rear end lift-up faces so as to be rotatable in a direction parallel with the sheet transferring direction in a state of being protruded upward slightly higher than a part of a maximum height which has been inclined upward in the rear end lift-up face.

* * * * *